United States Patent [19]

Ashida

[11] 4,241,437

[45] Dec. 23, 1980

[54] SIMULATED PENDULUM CLOCK

[75] Inventor: Itaru Ashida, Tokyo, Japan

[73] Assignee: Kabushiki Kaisha Seikosha, Tokyo, Japan

[21] Appl. No.: 926,632

[22] Filed: Jul. 21, 1978

[30] Foreign Application Priority Data

Jul. 26, 1977 [JP] Japan ..... 52/89580

[51] Int. Cl.[3] ..... G04B 15/00; G04F 5/00

[52] U.S. Cl. ..... 368/134; 368/165

[58] Field of Search ..... 35/13, 39; 58/29, 129; 368/134, 165

[56] References Cited

U.S. PATENT DOCUMENTS 1,831,260 11/1931 Poole ..... 58/29

3,802,181 4/1974 Marquis ..... 58/129

*Primary Examiner*—John W. Shepperd

*Attorney, Agent, or Firm*—Robert E. Burns; Emmanuel J. Lobato; Bruce L. Adams

[57] ABSTRACT

A simulated pendulum clock has a pendulum which rocks to and fro for decorative purposes only thereby simulating a pendulum clock of the type having a rocking pendulum for timekeeping purposes. A transmission wheel is rotationally driven by the timepiece movement of the clock and a friction clutch mechanism transmits the rotational movement of the transmission wheel to a rotating member whenever the load on the rotating member is less than a predetermined value and otherwise enables slipping of the transmission wheel relative to the rotating member. A toothed escape wheel is coaxially mounted with the rotating member and is connected thereto through a coil spring which applies a rotating torque to the escape wheel. The teeth of the escape wheel coact with a pair of pallet pins of a pallet which is mounted to undergo rocking movement in response to alternative engagement and disengagement of the pallet pins with the escape wheel teeth. A pendulum is fixedly secured at one end to the clock case and hangs downwardly therefrom in juxtaposition with the pallet, the pendulum being connected to the lower end of the pallet so as to transmit the rocking movement of the pallet into a rocking two-and-fro movement of the pendulum thereby simulating a pendulum clock.

3 Claims, 3 Drawing Figures

SIMULATED PENDULUM CLOCK

BACKGROUND OF THE INVENTION

The present invention relates to a simulated pendulum clock. A simulated pendulum clock is a pendulum clock having a pendulum which functions as a rocking decoration without acting as a time controller of the timepiece movenment.

In the conventional simulated pendulum clock, an electro-magnetic device is employed to drive a pendulum, the electro-magnetic device being functionally separated from the timpiece movement. However, in such a simulated pendulum clock, there are such disadvantages as the number of component parts, the complication of the structural configuration and the increase in the manufacturing cost, because of the need to employ many expensive parts, such as a coil, a magnet and a transistor, for constructing the above-mentioned electro-magnetic device.

SUMMARY OF THE INVENTION

The present invention intends to eliminate disadvantages in conventional simulated pendulum clocks.

The first feature of the present invention is that the well-known simple mechanism comprised of an escape wheel, a pallet and a spring is employed as the driving means of a pendulum, the spring for giving torque to the escape wheel being wound up by a timekeeping movement. However, this pendulum only controls the rotating speed of the escape wheel without acting as a time controller of a timepiece movement.

The second feature of the present invention is that a rotating member for winding up the above-mentioned spring and a transmission wheel for driving this member are coupled by a predetermined frictional connecting force by employing a slipping clutch mechanism, the rotating speed of the transmission wheel being a little higher than that of the escape wheel.

BRIEF DESCRIPTION OF THE DRAWING

Other features and advantages will be apparent from the following description and the attached drawings in which.

DESCRIPTION OF THE EMBODIMENT

Figure 1:
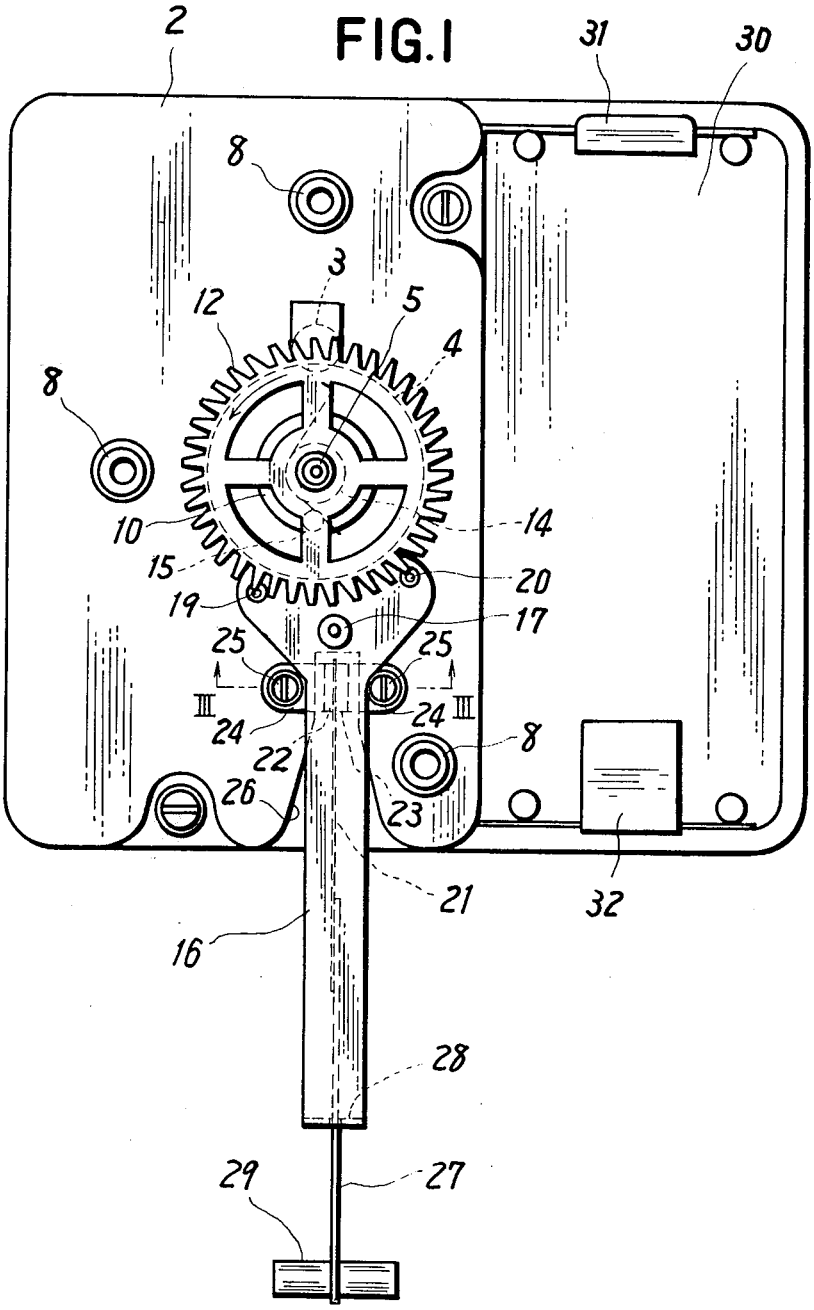
FIG. 1 is a rear view of a simulated pendulum clock with the rear supporting plate removed to show the interior.

Referring to the attached drawings, a timepiece movement for driving the hands of the clock is disposed within a front case 1 and a rear case 2. This timepiece movement comprises a driving circuit block containing a quartz oscillator, a motor block and gear train (none of which is shown) as well known in the art. A pinion 3, which is fixed to an arbor of the third wheel of the above-described gear train, projects from the rear case 2 and engages with a transmission wheel 4. The transmission wheel 4 is fixed to an arbor 5 which is rotatably surported by a bearing 6 of the rear case 2 and by a rear supporting plate 7. The rear supporting plate 7 is fixed to posts 8 projecting from the rear case 2 with screws 9. A rotating member 10 is rotatable about the arbor 5, the rotating member 10 being in contact with a portion of the arbor 5 with a predetermined frictional connecting force. This frictional connecting force is achieved by virtue of the force a leaf spring 11 which is disposed between the transmission wheel 4 and the rotating member 10. Consequently, the arbor 5 (the transmission wheel 4) and the rotating member 10 rotate in unisan together while the load acting on the rotating member 10 is less than the above-described frictional connecting force, and both of these parts slip relative to each other in the event the load becomes greater than the frictional connecting force. An escape wheel 12 is forced fit on to a bush 13 which is rotatable about the arbor 5. A coil spring 14 has one end thereof hung on and connected to the escape wheel 12 and the other end thereof hung on and connected a pin 15 fixed to the rotating member 10 and the spring 14 is wound around the bush 13.

Figure 2:
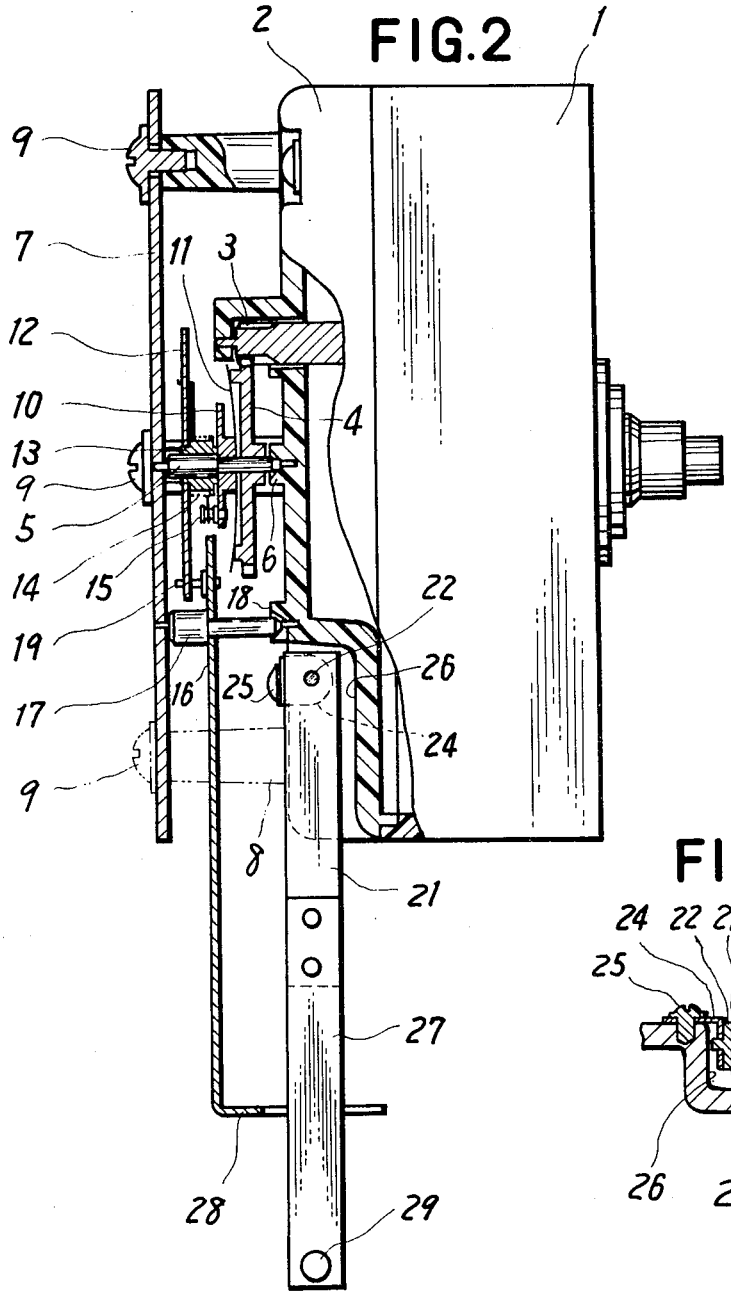
FIG. 2 is a side view thereof illustrated partly in section.
Figure 3:
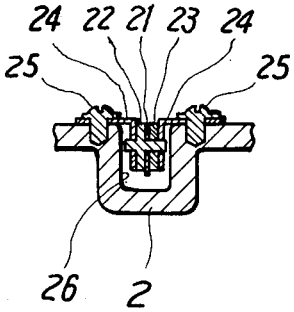
FIG. 3 is a section view thereof taken along section line III—III in FIG. 1.

A pallet 16 is provided with a pallet arbor 17, pallet pins 19, 20 and a pallet fork 28. The pallet arbor 17 is rotatably supported by the rear supporting plate 7 and by a bearing 18 of the rear case 2. The pallet pins 19 and 20 alternatively go in and out of the teeth of the escape wheel 12 every time the pallet 16 rocks clockwise and counter-clockwise. As shown in FIGS. 2 and 3, a suspension leaf spring 21 is clamped between supporting members 22 and 23, the head portions of the supporting member 22 being caulked to "L"-shaped plates 24 fixed on the rear case 2 with screws 25, 25. And this suspension leaf spring 21 is situated in a concave portion 26 of the rear case 2.

A pendulum employed in this clock is constructed with an upper pendulum 27 and a lower pendulum (not shown), the same as the well-known conventional pendulum. The upper pendulum 27 includes the leaf spring 21 and is fixedly secured at its upper end to the rear case 2 and has a hook pin 29 for hanging the lower pendulum at its lower end. As shown in the drawing, the upper pendulum 27 hangs downwardly from its upper end in juxtaposition with the pallet 16 which has a slot in its lower end to receive the upper pendulum thereby transmitting rocking movement of the pallet into to-and-fro movement of the pendulum. The lower pendulum is removably mounted on the hook pin 29 and it is constructed in a pendulum bob rod and a pendulum bob (neither is shown).

Further, as shown in FIG. 1, a battery case 30 is formed in the front case, the battery case 30 being provided with a plus contact plate 31 and a negative contact plate 32, for suplying the energy of a battery (not shown) to the abovementioned timepiece movement.

When a battery is mounted into the battery case 30, the timepiece movement within the cases 1 and 2 is driven and thus the hands for displaying time are driven. The pinion 3 is driven also at the same time, the rotation thereof being transmitted to the transmission wheel 4. Providing the above-described pendulum with the starting force by manual operation, the pendulum starts to rock at the predetermined period. Thus, the pallet 16 is interlocked to rock about the arbor 17, and the pallet pins 19 and 20 alternatively engage and disengage with the teeth of the escape wheel 12. As the escape wheel 12 is applied with a counter-clockwise torque (as shown by arrow in FIG. 1) about the arbor 5 by virtue of the force of the spring 14, the wheel rotates pitch by pitch every time the pallet pins 19 and 20 make engagement and disengagement with the wheel. The pallet pins 19 and 20 are applied impulses from the teeth of the escape wheel 12 when the former go out the latter, the rocking motion of the pendulum being maintained by virtue of the succession of impulses. The spring 14 is kept loose for the sake of the rotation of the escape wheel 12' on the one hand, the spring 14 being wound up by the pin 15 of the rotating member 10, which is connected to the arbor 5 with the predetermined frictional connecting force due to the force of the leaf spring 11, on the other hand. The arbor 5 and the rotating member 10 rotate together as one body under the condition that the frictional connecting force overcomes or exceeds the load acting on the rotating member 10' i.e. the force charged in the spring 14; however, both of these slip at their contacting surfaces as soon as the load becomes equal to the frictional connecting force. Consequently, the force of spring 14' i.e. the rotating torque of the escape wheel 12' is determined by the frictional connecting force.

In the case of this embodiment, it is designed so that the rotating speed of the transmission wheel 4 is a little higher than that of the escape wheel 12. Thus, the transmission wheel 4 always rotates to urge the rotating member 10. As a result, the force of the spring 14 is always maintained at a constant value, and the escape wheel 12 is stably driven with a constant rotating torque.

In the case of the simulated pendulum clock according to the present invention as described above in detail, the simulated pendulum clock can be manufactured at comparatively lower cost as it does not need to use the expensive parts such as a coil, a magnet and transistors. Further, it is possible to employ even a low power timepiece movement such as a quartz clock as the load on the timepiece movement because the power which is required to wind up the spring 14 is small, and thus the kinds of quartz clock may vary greatly. Furthermore, the force charged or stored in the spring 14 is always maintained at an appropriate constant value as the arbor of the transmission wheel and the rotating member are connected with the predetermined frictional connecting force, and as the rotating speed of transmission wheel is a litte higher than that of the escape wheel. Thus, the escape wheel is driven at a constant rotating torque, and the pendulum is driven and operated in a stable manner.

What is claimed is:

1. In a simulated pendulum clock of the type having a timepiece movement for driving the hands of the clock: a transmission wheel rotationally driven during use of the clock; a rotating member mounted for rotation; means for transmitting rotational movement of said transmission wheel to said rotating member whenever the load on said rotating member is less than a predetermined value and otherwise enabling movement of said transmission wheel relative to said rotating member; an escape wheel having a set of teeth about its periphery and mounted coaxially with and adjacent to said rotating member to undergo rotational movement; spring means coacting with said rotating member for applying a rotating torque to said escape wheel tending to rotate said escape wheel, said spring means comprising a coil spring having one end connected to said rotating member and the other end connected to said escape wheel; a rockable pallet mounted for rocking movement and having a pair of pallet pins alternately engageable and disengageable with the teeth of said escape wheel during rotation thereof to effect rocking movement of said pallet; and a pendulum fixedly secured at its upper end and hanging downwardly therefrom in juxtaposition with said pallet and connected to the lower end of said pallet to transmit the rocking movement of the pallet into a rocking to-and-fro movement of said pendulum.

2. A simulated pendulum clock according to claim 1 further comprising a rotatable arbor having said transmission wheel fixed thereto for rotation therewith and having said rotating member and said escape wheel each rotatably disposed thereon for rotation relative thereto.

3. A simulated pendulum clock according to claim 1 wherein said pendulum includes an upper portion comprised of a leaf spring which is fixedly secured at its upper end.

* * * * *